US005559588A

United States Patent [19]

Larson et al.

[11] Patent Number: 5,559,588

[45] Date of Patent: Sep. 24, 1996

[54] LID MACHINE CAPABLE OF PRODUCING CLEAN-BACKGROUND STABILIZED LIQUID TONER IMAGES

[75] Inventors: James R. Larson, Fairport; Anthony M. Wallace, Penfield; Clifford H. Griffiths; Dennis A. Abramsohn, both of Pittsford, all of N.Y.

[73] Assignee: Xerox Corporation, Stamford, Conn.

[21] Appl. No.: 527,615

[22] Filed: Sep. 13, 1995

[51] Int. Cl.[6] ..... G03G 9/13; G03G 9/00

[52] U.S. Cl. ..... 355/256; 118/652; 430/119

[58] Field of Search ..... 355/256; 118/652; 430/115, 116–119, 112–114

[56] References Cited

U.S. PATENT DOCUMENTS

| | | | |
|---|---|---|---|
| H1,483 | 9/1995 | Larson et al. | 430/115 |
| 3,663,219 | 5/1972 | Takahashi | 355/256 |
| 3,907,423 | 9/1975 | Hayashi et al. | 355/10 |
| 4,286,039 | 8/1981 | Landa et al. | 118/661 |
| 5,028,964 | 7/1991 | Landa et al. | 355/273 |

*Primary Examiner*—Joan H. Pendegrass
*Assistant Examiner*—Quana Grainger
*Attorney, Agent, or Firm*—Tallam I. Nguti

[57] ABSTRACT

A liquid ink development (LID) reproduction machine for producing a stabilized liquid toner image having clean-background areas. The reproduction machine includes a movable image bearing member having a photoconductive surface, and latent image forming devices for forming a latent image on the photoconductive surface such that the latent image has image areas and background areas. The reproduction machine also includes a development apparatus containing liquid toner developer material for developing the latent image. The liquid toner developer material includes a carrier liquid having a relatively low conductivity for preventing shorting of image conditioning electric fields through a layer of the liquid toner developer material forming the image. The liquid toner developer material also includes charged toner particles dispersed within the carrier liquid and having a relatively high charge level per toner particle for making the toner particles more sensitive to a low voltage image conditioning electric field. More importantly, the reproduction machine includes an image stabilization roller having a relatively low voltage biasing field for image conditioning so as to achieve effective image stabilization as well as clean developed image background areas.

8 Claims, 1 Drawing Sheet

LID MACHINE CAPABLE OF PRODUCING CLEAN-BACKGROUND STABILIZED LIQUID TONER IMAGES

BACKGROUND OF THE INVENTION

This invention relates to electrostatographic reproduction machines, and more particularly to a liquid immersion development (LID) reproduction machine capable of producing stabilized liquid toner images having clean backgrounds.

Liquid electrophotographic reproduction machines are well known, and generally each include a development system that utilizes an ink or liquid developer material typically having about 2 percent by weight of fine solid particulate toner material dispersed in a liquid carrier. Liquid electrophotographic reproduction machines as such can produce single color images or multicolor images for transfer onto a recording or copy sheet. The liquid carrier is typically a hydrocarbon. In the electrophotographic process of such a machine, a latent image formed on an image bearing member or photoreceptor is developed with the ink or liquid developer material. The developed image on the photoreceptor typically contains about 12 percent by weight of particulate toner in liquid hydrocarbon carrier. To improve the quality of transfer of the developed image from the photoreceptor to a receiver, the image is first conditioned so as to increase the percent solids of the liquid developer forming the image to about 25 percent. Such conditioning is achieved by removing excess hydrocarbon carrier liquid from the developed liquid image. Such removal, however, must be carried out in a manner that results in minimum degradation of the formed liquid toner image. The conditioned image is then subsequently transferred to a final copy sheet or to a receiver which may be an intermediate transfer member, and then to a recording or copy sheet for fusing thereon to form a hard copy.

Conditioning of liquid toner or LID images as above is necessary in order to remove excess hydrocarbon or carrier liquid from the developed images, and in order to stabilize the images particularly for the subsequent transfer steps. One method and apparatus for removing excess carrier liquid from a LID image as disclosed, for example, in U.S. Pat. No. 3,907,423 involves a biased controlled-velocity roller that is spaced from the developed LID image on the photoconductive surface. With this method and apparatus however, unacceptable amounts of carrier liquid are likely to be left in the LID image, and background areas, if partially developed, will remain uncleaned, and hence appear dirty when the image is transferred to a sheet of paper.

Another method and apparatus for removing excess carrier liquid from a LID image as disclosed, for example, in U.S. Pat. No. 5,028,964 involves a biased squeegee roller that actually contacts the developed LID image on the photoconductive surface. Although this particular method and apparatus can effectively remove desired amounts of carrier liquid from the image, it also unfortunately can tend to result in unacceptable offset of toner from the image to the image conditioning roller if the applied bias is relatively too low, that is, too close to zero or ground. On the other hand, if the bias is too high, that is, far from ground, it can prevent the undesirable offset but it can also result in undesirable background toning, in material breakdown, and in undesired overcharging. It is therefore desirable to have a system that results in effective image conditioning and does not require high biases to prevent offset of toner from the image to the image conditioning roller.

SUMMARY OF THE INVENTION

In accordance with one aspect of the present invention, there is provided a liquid immersion development (LID) reproduction machine for producing a stabilized liquid toner image having clean-background areas. The reproduction machine includes a movable image bearing member having an image bearing surface, and latent image forming means mounted along a path of movement of the image bearing member for forming a latent image electrostatically on the image bearing surface such that the latent image so formed has image areas and background areas. The reproduction machine also includes a development apparatus containing liquid toner developer material for developing the latent image. The liquid toner developer material includes a carrier liquid having a relatively low conductivity within a range from 0.01 to 1.00 pmho/cm.

The liquid toner developer material also includes charged toner particles dispersed within the carrier liquid and having a relatively high charge level per toner particle resulting in an absolute zeta potential with a range 150 to 400 mV as measured by a Matec ESA device, for making the toner particles more sensitive to a low voltage image conditioning electric field.

More importantly, the reproduction machine includes means for removing excess carrier liquid from the developed latent image, as well as an image stabilization roller. The image stabilization roller has a relatively low image conditioning biasing voltage having an absolute value within a range from 200 to 1500 volts.

DESCRIPTION OF THE DRAWINGS

Other aspects of the present invention will become apparent as the following description proceeds and upon reference to the drawings, in which.

DETAILED DESCRIPTION OF THE INVENTION

Figure 1:
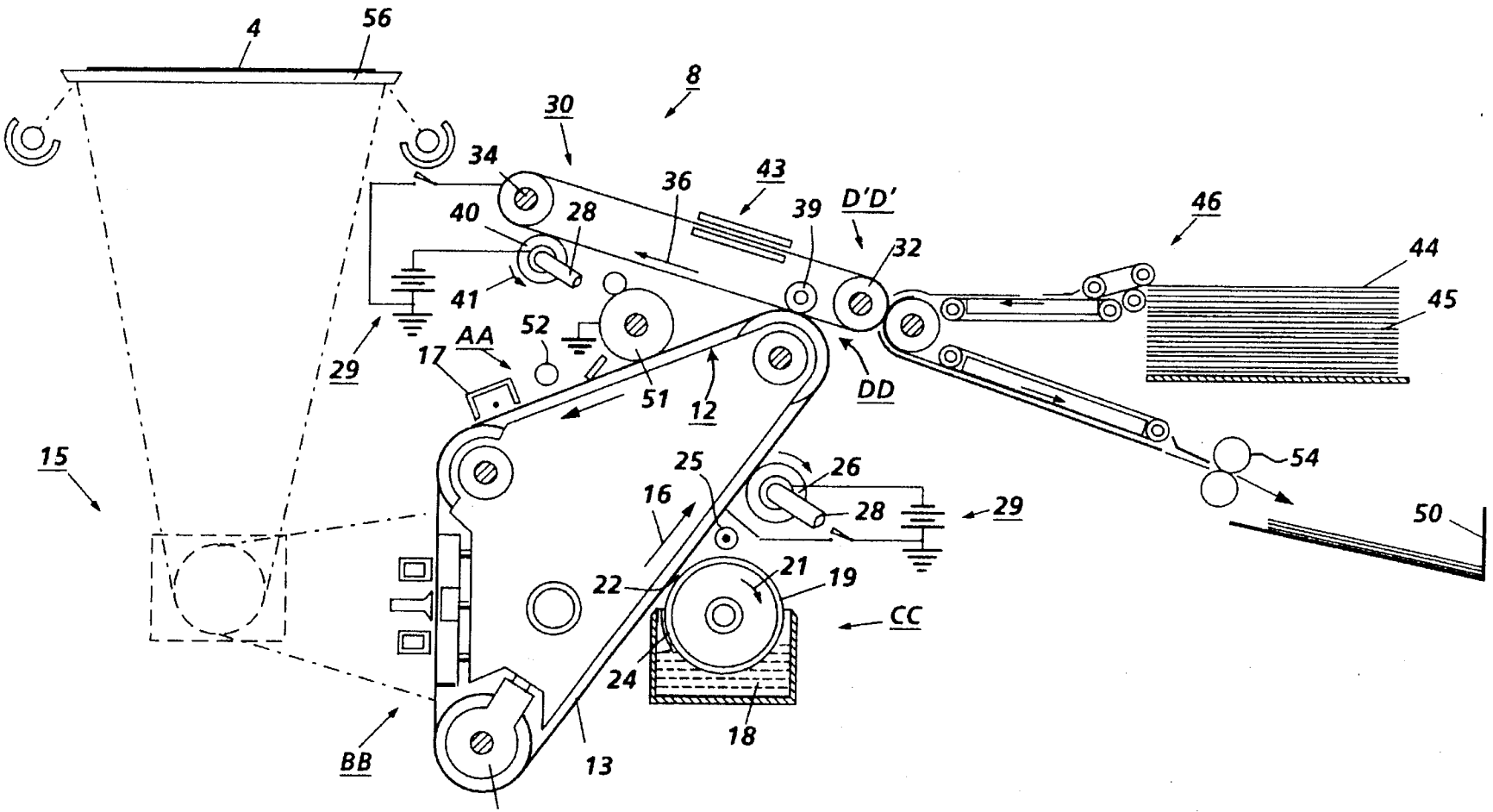
FIG. 1 is a schematic, elevational view of an electrophotographic liquid toner reproduction machine incorporating the combination of liquid developer material and image conditioning apparatus of the present invention.

For a general understanding of the features of the present invention, reference numerals have been used throughout to designate identical elements. It will become evident from the following discussion that the present invention is equally well suited for use in a wide variety of reproduction machines including those that utilize ionographically written latent electrostatic images on a dielectric surface. The invention, therefore, is not necessarily limited in its application to the particular embodiment depicted herein.

Inasmuch as the art of electrophotographic reproduction is well known, the various processing stations employed in the FIG. 1 reproduction machine will be shown hereinafter only schematically, and their operation described only briefly.

Referring to the drawing, (FIG. 1), there is shown a reproduction machine 8 employing a belt 12 including a photoconductive surface 13 deposited on a conductive substrate. A roller 14 rotates and advances belt 12 in the direction of arrow 16. Belt 12 passes through charging station AA where a corona generating device 17 charges the photoconductive surface 13 of the belt 12, a portion at a time to a high and generally uniform potential. The charged portions of belt 12 are advanced sequentially to an exposure station BB where image rays from an original document 4 positioned on a platen 56 are projected by means of an optical system 15 onto a charged portion of the photoconductive surface 13 so as to record thereon an electrostatic latent image. Alternatively as is well known, a raster output scanner (ROS) device (not shown) can be used to write a latent image bitmap from digital electronic data by selectively erasing charges in areas of a charged portion on the charged belt 12. Such a ROS device writes the image data pixel by pixel in a line screen registration mode. In either case, it should be noted that the latent image can be thus formed for a discharged area development (DAD) process machine in which discharged areas are developed with toner, or for a charged area development (CAD) process machine in which the charged areas are developed with toner.

After the electrostatic latent image has been recorded thus, belt 12 advances to development station CC where liquid ink or toner developer material 18 according to the present invention is used to develop or make visible the latent image. The liquid ink or toner developer material 18 of the present invention is contained in a chamber of a development apparatus 20. The ink or developer material 18 includes any of several hydrocarbon liquids, including hydrocarbons such as high purity alkanes including from about 6 to about 14 carbon atoms. Preferably, the carrier liquid has a relatively low conductivity within a range from 0.01 to 1.00 pmho/cm. Isoparaffinic hydrocarbons are additionally preferred since they are colorless, environmentally safe, and possess a sufficiently high vapor pressure so that a thin film of the liquid evaporates from the contacting surface within seconds at ambient temperatures. Generally, the carrier liquid is present in a large amount in the toner developer material composition, and constitutes that percentage by weight of the developer material that is not accounted for by the other components. For example, the carrier liquid is usually present in an amount of from about 80 to about 98 percent by weight.

The liquid toner developer material 18 also includes toner particles that are dispersed within the carrier liquid forming a dispersion, and a charge director which is required to impart charge onto the toner particles. Depending on the image scheme, the charge on the toner particles may be either negative or positive. The charge director is selected and is added in a concentration such that the toner particles are charged to a relatively high charge level per toner particle resulting in an absolute zeta potential within a range of 150 to 400 mV (as measured by a Matec ESA device) so as to make the toner particles more sensitive to a low voltage image conditioning electric field of the present invention. In addition, the charged director is so added such that the conductivity of the dispersion is maintained within a range of 8 to 20 pmhos/cm for preventing shorting of image conditioning electric fields through a layer of the liquid toner developer material forming the image.

The toner particles can be any colored particle compatible with the liquid carrier of the present invention. For example, the toner particles can consist solely of pigment particles, or may comprise a resin and a pigment; a resin and a dye; or a resin, a pigment, and a dye. Pigments generally are present in an amount of from about 5 to about 30 percent by weight of the toner particle, although other amounts may be present. Generally, any pigment material is suitable provided that it consists of small particles and that it combines well with any polymeric material also included in the ink or developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. In accordance with the present invention, the toner particles should have a charge level per particle resulting in an absolute zeta potential within a range of 150 to 400 mV, and preferably 170 to 250 mV, as measured by a Matec ESA device. The toner particles may be present in amounts of from about 1 to about 10, and preferably from about 2 to about 4 percent by weight of the developer composition.

One example of such ink or developer material is an experimental cyan ink or liquid developer, referred to as Mark 1 ink by Assignee Xerox Corporation. Mark 1 ink is a 2 wt % solids ink charged negatively with a charge director compound (4K-HBr-QUAT) which is an HBr salt of poly-2-ethylhexylmethacrylate-co-N',N'-dimethylamino-2-ethylmethacrylate (EHMA-DMAEMA) A-B diblock copolymers having an average molecular weight of about 4000 which form inverse micelles with the ammonium ionic or polar end of the block copolymer faced inward, and the nonpolar EHMA tail pointing in a direction outward toward the hydrophobic hydrocarbon. The negative toner particles contained therein have a per particle charge level of about −146.4 mv at a charge director concentration of 30 mg/g, that is, 30 milligrams of charge director solids to 1 gram of toner solids. Additionally, this ink includes Aluminum Stearate as a charge control agent, and a hydrocarbon carrier liquid. The conductivity of the toner dispersion is about 18.00 pmhos/cm and its dynamic mobility is about −2.24 E-10 $m^2$/vs as measured by the Matec ESA.

Another example of such ink is also an experimental ink or liquid developer, referred to as Mark II ink by Xerox. Mark II ink is a 2 wt % ink, charged negatively with charge director compound (93K-HBrQUAT) which is an HBr salt of poly-2-ethylhexylmethacrylate-co-N',N'-dimethylamino-2-ethylmethacrylate (EHMA-DMAEMA) A-B diblock copolymers having an average molecular weight of about 93,000 which form inverse micelles with the ammonium ionic or polar end of the block copolymer faced inward, and the nonpolar EHMA tail pointing in a direction outward toward the hydrophobic hydrocarbon. The toner particles have a per particle charge level of about −176.9 mv at a charge director concentration of 100 mg/1 g. Additionally, this ink includes Alohas, an aluminum alkyl salicylate disclosed in U.S. Pat. No. 5,366,840 as a charge control agent, and a hydrocarbon carrier liquid. The conductivity of the toner dispersion is about 8.00 pmhos/cm, and its dynamic mobility is about −3.27E-10 $m^2$/vs as measured by the Matec ESA.

The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particular mobilities and zeta potentials were determined with a MBS-8000 electrokinetic sonic analysis (ESA) system (Matec Applied Scient Hopkinton, Mass.). The system was calibrated in the aqueous mode per manufacturer's recommendation to provide an ESA signal corresponding to a zeta potential of −26 millivolts for a 10 percent (v/v) suspension of LUDOX™ (DuPont). The system was then set up for nonaqueous measurements. The toner particle mobility is dependent on a number of ESA system also calculates the zeta potential which is directly proportional to toner charge and is independent of particle size. Particle size was measured by the Horiba CAPA-500 and 700 centrifugal automatic particle analyzers manufactured by Horiba Instruments, Inc., Irvine, Calif.

The liquid developer material or ink 18 including the liquid carrier and charged toner particles according to the present invention are advanced from the chamber of the development apparatus 20 by a development roller 19 rotating in the direction of arrow 21, through a development zone or nip 22 for latent image development. An electrode 24 positioned before an entrance into development nip 22 is electrically biased so as to disperse the charged toner particles as solids in a substantially uniformly manner throughout the liquid carrier.

Development station CC also includes a carrier liquid metering roller 25, and in combination with the ink above, a biased image conditioning or squeegee roller 26 according to the present invention for removing additional excess carrier liquid from the developed latent image, as well as for stabilizing the image. The squeegee roller 26 according to the present invention has a relatively low, that is, close to zero or ground potential, image conditioning biasing voltage preferably having an absolute value within a range from 200 to 1500 volts (its polarity depending on the polarity of the charge on the toner particles) for combining with the ink characteristics above so as to achieve effective image stabilization as well as clean image background areas. The biasing voltage thus will be negative if a negatively charged toner is used. In the case where a positively charged toner is used the desired range of image conditioning biasing voltage is between +200 to +1500 volts. The conditioning roller 26 is, for example, a porous blotter roller having perforations through the skin surface thereof. An example of such a roller 26 is disclosed in commonly assigned U.S. Pat. No. 5,424,813 which is fully incorporated herein by reference.

Roller 26 is mounted so as to contact the liquid toner developed image on belt 12, and so as to condition the liquid image by reducing its fluid content (thereby increasing its percent solids) while at the same time inhibiting the departure of toner particles from the image. The roller 26 operates in conjunction with a vacuum device 28 for removing the liquid carrier from the liquid toner image. A relatively low bias voltage within a preferred range of −200 to −800 volts (in the case of negative inks) according to the present invention, is applied to roller 26 from a source 29. The relatively low voltage combines with the low conductivity of the carrier liquid and with the relatively high charge levels of the toner particles to create a toner repelling force in image areas, as well as a cleaning or toner removing force in background areas of the developed image. This results in prevention of toner offset or prevention of toner particles from leaving the photoconductive surface and entering the roller 26. It, however, does not overcharge and also removes toner from background areas and so results in images with relatively cleaner backgrounds.

The apparatus used to test this concept, operates at 17 inches per second (ips), and is comprised of a charge scorotron, a discharge lamp, a development housing, a metering roll, a cleaner assembly and a conditioning or squeegee roll. A photoconductive film utilized was wrapped around an aluminum substrate and grounded through the inboard end of the film material. The photoconductive film was first charged to approximately −800 V. Image areas were then discharged to below −100 V by the discharge lamp while the background areas stayed highly charged. The image was developed using ink according to the present invention, and then metered to remove excess carrier liquid. The metering roll was rotated reversely relative to the direction of the photoconductive surface, and was biased to −300 V in order to remove excess toner and hydrocarbon. After such metering the developed image was then squeegeed by using a rubber roller which is engaged by air pressure (at about 40 PSI) and biased according to the present invention within a relatively low range from negative −400 V to −2000 V (for the negative ink) via a suitable power supply. The squeegee roller was friction driven by the aluminum substrate. LID images were produced as above using an experimental cyan ink having Alohas as a charge control agent (CCA); and a Charge Director=93K HBr-QUAT having a low conductivity carrier liquid and a high particle charge level. The results were images which were cleanly stabilized with reduced levels of background remaining when the images were transferred. Off-set of toner particles from the photoconductive surface to the conditioning roller occured only in the background areas, and not in the image areas of the images.

It is believed that in the machine 8, the relatively low (that is, close to ground) bias voltage on the roller 26 acts like a development field to compress the toner particles in the image areas, by holding or keeping them against the photoconductive surface 13. The conformability of the nip of the roller 26 with the surface 13 and the gap in the nip acts to extract carrier liquid from the image areas and from the background areas. It should be noted otherwise that for the same nip geometry, the higher (that is, the further from ground) the bias voltage of the source 29, the stronger the field in the nip, and hence the more the compression of the toner particles forming the image resulting in a tendency of toner to offset onto the image conditioning roller. Unfortunately, however, such a high bias voltage has a tendency to overcharge conventional, non-low conductivity inks. In such overcharged liquid developer or ink, toner in background areas will tend to be also compressed against the surface 13 along with toner particles in image areas, when under a high bias voltage field. Relatively low bias voltages are therefore preferred when used with low conductivity and relatively high charge per particle inks or liquid developer according to the present invention. This is because some of the lower conductivity liquid developers or inks have field dependent charging levels—charging superlinearly with increasing field.

The ability of the roller 26 to extract excess carrier liquid from developed liquid toner images at low bias voltages according to the present invention, has several advantages, particularly in the case of the lower conductivity inks that have field dependent charging levels. Advantageously according to the present invention, at relatively lower conditioning voltages, such an ink becomes or remains much less charged (as opposed to being overcharged) than it would be under a relatively high field. Thus, toner particles in background areas are much more likely to stay in suspension for removal with the excess carrier liquid, and not to be compressed against the photoconductive surface 13. Experimental runs have demonstrated that the relatively lower biasing fields actually result in a removal of toner particles from background areas of images being conditioned, thus resulting in higher print quality as illustrated in the Table below. Note that preferred results as according to the present invention were obtained in row three of the table combining a low conductivity (8 pmho/cm); a high particle charge level (zeta potential of −177 mV), and a low bias voltage −400 volts (given the negative toner).

| Ink | Description | Potential Applied to image conditionin roller | Description of liquid toner image after image conditioning |
|---|---|---|---|
| Mark I | high conductivity (18 pmho/cm); moderate particle charge (zeta potential of −146 mV) | −400 volts (low voltage) | clean background; unacceptable offset to squeegeee roller |
| Mark I | high conductivity (18 pmho/cm); moderate particle charge (zeta potential of −146 mV) | −1500 volts (high voltage) | unacceptable background; no offset to squeegee roller |
| Mark II | low conductivity (8 pmho/cm); high particle charge (zeta potenial of −177 mV) | −400 volts (low voltage) | clean background; no offset to squeegee roller |

It is also believed that such toner particle removal is due to the fact that the background toner particles, in a low conductivity carrier liquid and under a low bias field, were less likely to be further charged and developed or further pushed to the photoconductive surface 13, before their removal along with the carrier liquid in which they are ordinarily dispersed. Thus in a LID image combining the use of low conductivity and high charge per particle inks with relatively low image conditioning fields, the low fields act advantageously to produce just enough force to hold developed toner images being conditioned to the photoconductive surface. Thus, this allows for the removal of excess carrier liquid without image degradation. At the same time such a force is not enough of a force during the time in the low conductivity liquid and under the low field, to further charge and develop toner particles left in the background areas or in the liquid layer above image areas.

Thus, in the machine 8, the low voltage squeegee roller 26 can remove undeveloped and or background toner particles along with excess carrier liquid under the lower electric fields in all regions of space around the image. Accordingly, there is also less of a chance or a lower chance for material breakdown in small gaps and less of a chance of Paschen breakdown (in air gaps) resulting in less loss of charge and better transfer of entire images. Finally too, for the same charge flow, there is also a lower energy consumption under the ink and biasing characteristics of the present invention than under conventional LID machine conditions.

After the electrostatic latent image is developed and conditioned as above, belt 12 advances the image to transfer station DD where the image is electrostatically transferred from belt 12 to an intermediate member or belt 30. As shown, belt 30 is entrained about rollers 32 and 34, and is moved in the direction of arrow 36. A transfer roller 39 urges intermediate transfer belt 30 against image bearing belt 12 in order to assure effective transfer of the conditioned liquid toner image from belt 12 to the intermediate belt 30. A second image conditioning roller such as a porous blotter roller 40 according to the present invention, having perforations through the roller skin covering, also then contacts the transferred image on belt 30 to further reduce its fluid content (increasing its percent solids) while preventing toner particles from departing from the image. The roller 40 by further removing excess liquid carrier as such increases the percent solids to between 25 and 75.% by weight, for example.

In operation, roller 40 rotates in the direction of arrow 41 to impinge against the liquid toner image on belt 30. The porous body of roller 40 absorbs liquid from the surface of the transferred image. The absorbed liquid permeates through roller 40 and into an inner hollow cavity 49 thereof, where the vacuum device 28 draws such liquid out of the roller 40 and into a liquid receptacle for subsequent disposal or recirculation as liquid carrier. Porous roller 40 then continues to rotate in the direction of arrow 41 to ensure continuous absorption of excess liquid from liquid toner images on transfer belt 30. A bias voltage 29 in accordance with the present invention is also applied to the roller 40 to establish a repelling electrostatic field against charged toner particles forming the images, thereby preventing such toner particles from transferring to the roller 40, while meantime removing toner particles from background areas of the image.

Belt 30 then advances the transferred image to a second transfer station D'D' where a sheet of support material 44 is advanced from stack 45 of such sheets by a sheet transport mechanism 46. The transferred image from the photoconductive surface of belt 30 is then attracted or transferred to copy sheet 44. After such transfer, a conveyor belt 46 moves the copy sheet 44 through a fusing apparatus 54 to a discharge output tray 50.

Invariably, after the liquid toner image was transferred from the belt 12 to intermediate member 30, residual liquid developer material remained adhering to the photoconductive surface 13 of belt 12. A cleaning roller 51 formed of any appropriate synthetic resin, is therefore driven in a direction opposite to the direction of movement of belt 12 in order to scrub the photoconductive surface 13 clean. Any residual charge left on the photoconductive surface after such cleaning is erased by flooding the photoconductive surface with light from a lamp 52 prior to again charging the belt 12 for producing another image as above.

As can be seen, it has been shown that a relatively low voltage biased squeegee or conditioning roller can be effective in stabilizing liquid toner images while producing clean background areas, if ink or liquid developer toner particle charge is relatively high, and the conductivity of the carrier liquid is relatively low. The high particle charge of the toner particles acts to force the toner particles to be more sensitive to the low biasing voltage of the conditioning roller, and the low carrier liquid conductivity acts to prevent the shorting of image conditioning fields through the ink or liquid developer layer. An unexpected advantage with the relatively low voltage biased squeegee roller when used with such inks is that it removes toner particles from background areas of the images while relatively high voltage squeegee rollers tended to repel the background toner particles, thus leaving them with the image.

As is well known, an electronic control subsystem, such as an ESS 150, may be used for controlling various components and operating subsystems of the reproduction machine 8. The ESS 150, for example, may be a self-contained, dedicated minicomputer. As such, ESS 150 may include at least one, and may be several programmable microprocessors for handling all control data including control signals from control sensors of the various controllable aspects of the machine 8.

It is, therefore, evident that there has been provided, in accordance with the present invention, a reproduction machine that fully satisfies the aims and advantages hereinbefore set forth. While this invention has been described in conjunction with one embodiment thereof, it is evident that many alternatives, modifications and variations will be apparent to those skilled in the art. Accordingly, it is intended to embrace all such alternatives, modification and variations as fall within the spirit and broad scope of the appended claims.

We claim:

1. A liquid reproduction machine for producing a stabilized liquid toner image having clean-background areas, the reproduction machine comprising:

(a) a movable image bearing member having an image bearing surface;

(b) latent image forming means mounted along a path of movement of said image bearing member for forming a latent image electrostatically on said image bearing surface, said latent image having image areas and background areas;

(c) a development apparatus containing liquid toner developer material for developing said latent image, said liquid toner developer material including a carrier liquid having a relatively low conductivity within a range of 0.01 to 1.00 pmho/cm, and charged toner particles having a relatively high charge level per particle resulting an absolute zeta potential within a range of 150 to 400 mV dispersed within said carrier liquid; and (d) an image stabilization roller including a relatively low voltage bias having an absolute value within a range from 200 to 1500 volts, said relatively low voltage bias having a polarity selected to be of the same electrical sign as a polarity of the toner particle charge, so as to combine with low conductivity of the carrier liquid and high charge level per particle of the toner particles to achieve effective image stabilization and clean developed image background areas.

2. The liquid reproduction machine of claim 1, wherein said liquid developer material includes a charge director dispersed in said carrier liquid forming a dispersion for charging said toner particles, said charged director being selected so as to maintain the conductivity of the dispersion between 8 and 20 pmhos/cm.

3. The reproduction machine of claim 1, wherein said toner charge level per particle results in an absolute zeta potential within a preferred range of 170 mV to 250 mV.

4. The reproduction machine of claim 1, wherein said liquid toner developer material includes a hydrocarbon carrier liquid and a 2 wt % toner charged with a HBr quat charge director at a solids concentration within a range of 30 to 100 mg/gm.

5. The reproduction machine of claim 4, wherein said liquid toner developer material includes an aluminum alkyl salicylate as a charge control agent.

6. The reproduction machine of claim 4, wherein said liquid developer has a dispersion conductivity of less than 16.0 pmhos/cm.

7. The reproduction machine of claim 4, wherein said liquid toner developer has an absolute dynamic mobility within a range of 2.30 E- 10 to 10.0E-10 $m^2$/vs.

8. In a liquid immersion development (LID) reproduction machine, a method of producing effectively stabilized liquid toner developed images with clean background areas, the method including the steps of:

(a) electrostatically forming a latent image having image areas and background areas on an image bearing member;

(b) developing the latent image with liquid developer material including a liquid carrier having a relatively low conductivity of less than 1.00 pmho/cm, and toner particles, and a charge director for charging the toner particles, dispersed in the liquid carrier so as to result in a relatively high charge level per toner particle having an absolute zeta potential value within a range of 150 to 400 mV; and (c) contacting the developed image with an image stabilization and conditioning roller including a relatively low voltage bias having an absolute value within a range from 200 to 1500 volts, wherein the relatively low voltage bias has a polarity selected to be of the same electrical sign as a polarity of the toner particle charge so as to combine low conductivity of the carrier liquid and high charge level per particle of the toner particles to achieve effective image stabilization and clean background areas in developed images.

* * * * *